US005287618A

United States Patent [19]

Koegel et al.

[11] Patent Number: 5,287,618

[45] Date of Patent: Feb. 22, 1994

[54] METHOD FOR ORIENTATION OF AN ELECTRICAL CABLE

[75] Inventors: Keith S. Koegel, Linglestown; Robert E. Beamenderfer, Palmyra; Reuben E. Ney, Mount Joy; William D. Miknis, Lancaster, all of Pa.

[73] Assignee: The Whitaker Corporation, Wilmington, Del.

[21] Appl. No.: 672,299

[22] Filed: Mar. 20, 1991

Related U.S. Application Data

[62] Division of Ser. No. 492,694, Mar. 13, 1990, Pat. No. 5,038,001.

[51] Int. Cl.[5] ..... H01B 13/06

[52] U.S. Cl. ..... 29/828; 29/868

[58] Field of Search ..... 29/868, 869, 872, 874, 29/876, 884, 33 M, 828, 857; 439/63, 449, 452, 470, 497, 498, 578, 579, 590, 596; 174/112, 113, 107

[56] References Cited

U.S. PATENT DOCUMENTS

| | | | |
|---|---|---|---|
| 3,360,631 | 12/1967 | Hess | 29/447 X |
| 3,373,244 | 3/1968 | Holland | 29/828 X |
| 3,430,337 | 3/1969 | Kelly | 29/828 |
| 3,480,724 | 11/1969 | Garner | 29/828 X |
| 3,567,846 | 3/1971 | Brorein | 29/828 X |
| 3,727,174 | 4/1973 | Podmore et al. | 439/596 |
| 4,068,912 | 1/1978 | Hudson, Jr. et al. | 29/857 X |
| 4,313,247 | 2/1982 | Stuttard | 29/828 X |
| 4,365,856 | 12/1982 | Yaegashi et al. | 439/579 X |
| 4,404,425 | 9/1983 | Rich | 174/107 |
| 4,539,739 | 9/1985 | Himmelberger et al. | 29/868 X |
| 4,674,822 | 6/1987 | Hall | 439/579 X |
| 4,767,353 | 8/1988 | Hughes et al. | 439/590 X |
| 4,875,877 | 10/1989 | Fleak et al. | 439/497 |
| 5,021,611 | 6/1991 | Amano | 29/868 X |

FOREIGN PATENT DOCUMENTS

| | | | |
|---|---|---|---|
| 2920031 | 12/1979 | Fed. Rep. of Germany . | |
| 3733070 | 4/1989 | Fed. Rep. of Germany | 439/579 |

OTHER PUBLICATIONS

European Search Report No. 91301579.8 filed Jun. 25, 1991.

*Primary Examiner*—Peter Dungba Vo

[57] ABSTRACT

Multiple discrete coax cables 1 comprising: corresponding signal wires 2 and corresponding ground wires 5 within corresponding sheaths 4, the sheaths 4 having external profiles 56 extending along the lengths of corresponding cables 1 constructed for passage through corresponding eyes 64 conforming to the profiles 56, the cables 1 are flexible independently, and wires 2, 5 extend without skew along the corresponding axes of the independently flexible cables 1 for connection to a corresponding housing block 16 of a connector assembly 6.

7 Claims, 4 Drawing Sheets

METHOD FOR ORIENTATION OF AN ELECTRICAL CABLE

This application is a divisional of application Ser. No. 07/492,694 filed Mar. 13, 1990 now U.S. Pat. No. 5,038,001.

FIELD OF THE INVENTION

The invention relates to a feature on an electrical cable that facilitates orientation of the cable in a position such that two or more electrical wires of the cable are positioned for ease in wire handling.

BACKGROUND OF THE INVENTION

U.S. Pat. No. 3,775,552 discloses a coaxial cable assembly that has become known as ribbon coax cable, primarily because the cable assembly has a long, flat and wide planar shape resembling the shape of a ribbon. The ribbon coax cable includes multiple coaxial conductors and multiple drain wires parallel to one another in the cable assembly. This type of cable includes a jacket of insulative material that can be stripped from the coaxial conductors and the drain wires to leave bare coaxial conductors and bare drain wires precisely located for termination to a standard connector block without a need for reorienting the coaxial conductors and the drain wires before such termination.

Not all connector blocks are constructed for connection solely to a ribbon coax cable. Some connector blocks are suitable for connection to multiple coaxial cables, wherein each of the cables is known as a discrete coax cable, as distinguished from ribbon coax cable. The discrete coax cable includes a single set of coaxial conductors and a single drain wire, also called a ground wire. One such connector block is disclosed in U.S. Pat. No. 4,875,877, and comprises, an insulative housing block, conductive signal contacts having wire connecting portions for connection to corresponding signal wires, and wire connecting portions of a ground bus for connection to corresponding ground wires. The housing block is suitable for connection to multiple discrete coax cables, wherein each of the cables includes a signal wire and a corresponding ground wire within a sheath, and each signal wire is encircled concentrically by a corresponding dielectric.

The ribbon coax cable known from U.S. Pat. No. 3,775,552, combines multiple coaxial conductors and multiple drain wires in a single cable to facilitate wire handling. A need exits to facilitate wire handling of discrete coax cables, for example, to orient multiple discrete coax cables for connection to a connector block, such as a housing block as disclosed in U.S. Pat. No. 4,875,877.

A discrete coax cable is more flexible than a ribbon coax cable, particularly because a ribbon coax cable resists being flexed in the flat plane of such a cable. However, a discrete coax cable is also flexible in response to torsion applied to twist the cable, such that the cable might extend lengthwise along its longitudinal axis, but the conductors of the cable will have been displaced in response to torsion applied to the cable, and will extend helically about the axis, instead of extending parallel to the axis. Thus, such conductors are said to be skewed. When the conductors of the discrete coax cable are skewed, their orientations about the axis will vary along a helix, and will require that they be located visually and then manually grasped and reoriented such that the conductors are positioned for alignment with corresponding wire connecting portions of a connector block, for example, a housing block as disclosed in the U.S. Pat. No. 4,875,877. Before the invention, the wires were reoriented by hand. The time consuming task of orienting the wires by hand is alleviated by the invention.

SUMMARY OF THE INVENTION

The invention orients a single ground wire and a single coaxial conductor of a discrete coax cable. The invention enables wire handling of discrete coax cable for assembly with a housing block. The invention provides visual identification of the orientation of a discrete coaxial cable. The invention eliminates skew of a signal wire and a ground wire along a longitudinal axis of a discrete coax cable and positions them for ease of assembly with a connector block.

Accordingly, orienting a discrete coax cable is accomplished by the invention. A shaped profile along the length of a discrete coax cable corresponds to locations of a signal wire and a ground wire of the cable. By passing the profile against a fixture conforming to the shape of the profile, the signal wire and the ground wire are oriented by the fixture with respect to a longitudinal axis of the cable. The signal wire and the ground wire are positioned for assembly with a housing block without having to manually reorient the wires prior to such assembly.

The invention permits signal wires and ground wires of a discrete coax cable to extend without skew along the longitudinal axis of the cable as they extend between separate connector blocks.

The invention permits construction of a cable assembly comprising, discrete coax cables connected to a corresponding housing block, the discrete coax cables include first portions corresponding to positions of signal wires of the cable, and second portions of different appearance than the appearance of the first portions and corresponding to positions of ground wires of the cables, the cables are independently flexible, and the signal wires and the ground wires extend without skew along corresponding axes of the independently flexible cables to the housing block.

The invention permits construction of multiple discrete coax cables having corresponding signal wires and corresponding ground wires within corresponding sheaths, and corresponding dielectrics concentrically encircling the corresponding signal wires, comprising, discrete coax cables connected to a corresponding housing block, the discrete coax cables include first portions corresponding to positions of signal wires of the cable, and second portions of different appearance than the appearance of the first portions and corresponding to positions of ground wires of the cables, the cables are in a group, with the cables being flexible independently, and with the first portions and the second portions extending without skew along the corresponding axes of the independently flexible cables for connection to a corresponding housing block.

The invention will now be described by way of example with reference to the following description and the drawings.

Figure 1:
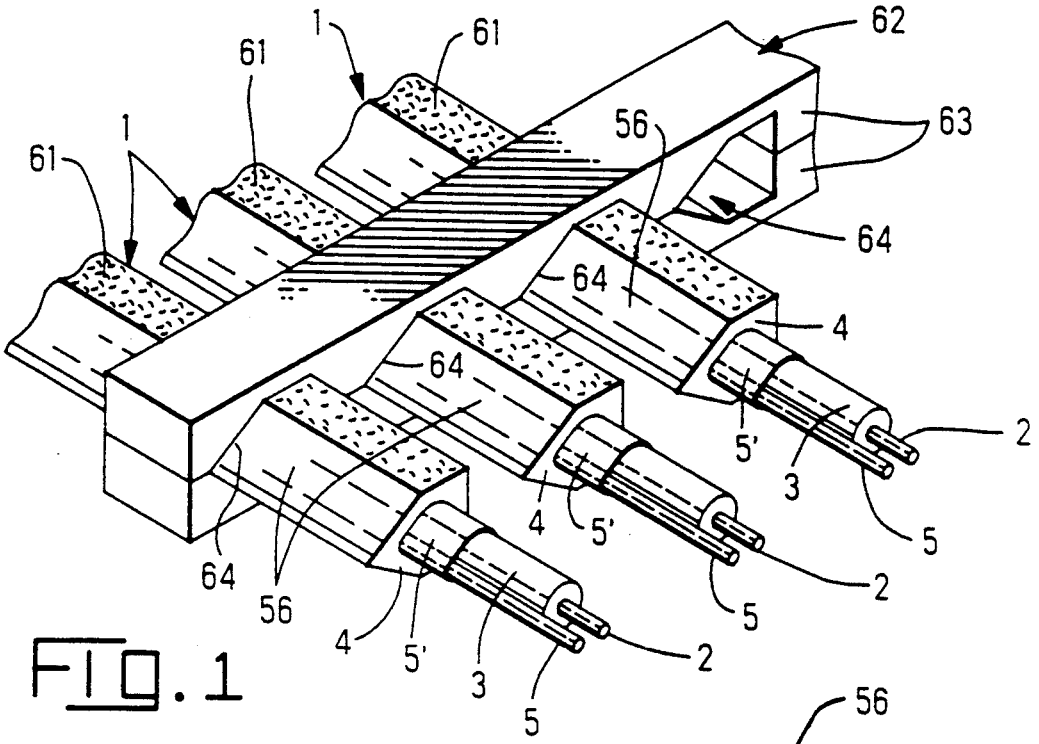
FIG. 1 is an enlarged perspective view of three cables and a portion of a fixture for orienting the cables
Figure 1A:
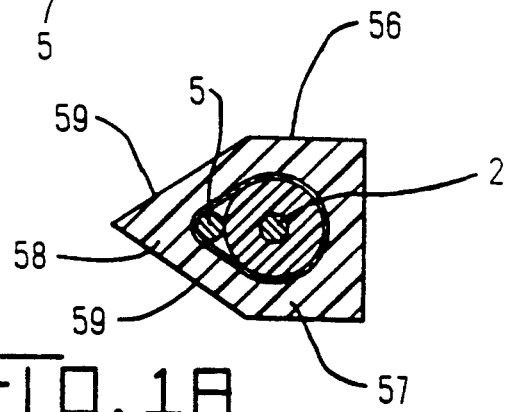
FIG. 1A is a cross section view of one of the cables.

A discrete coax cable 1 is described with reference to FIG. 1, and is constructed with an elongated signal wire 2 or center conductor concentrically encircled by a dielectric 3, in turn, encircled by a flexible and insulative outer jacket or sheath 4. An elongated and conductive ground wire 5 or drain wire extends along the exterior of the dielectric 3 and is within the jacket 4 or sheath. The cable construction is cut to expose the signal wire 2, the dielectric 3 and the ground wire 5 from the jacket 4 as shown in the Figure. Within the jacket 4 and encircling collectively, the ground wire 5, the dielectric 3 and the signal wire 2, is a flexible conductive shield 5' contacting the ground wire 5 and providing approximately a concentric shield encircling the signal wire 2 and the dielectric 3. When the cable 1 is cut, the shield 5' is flush with a cut end of the jacket 4, as shown in FIG. 4.

Figure 2:
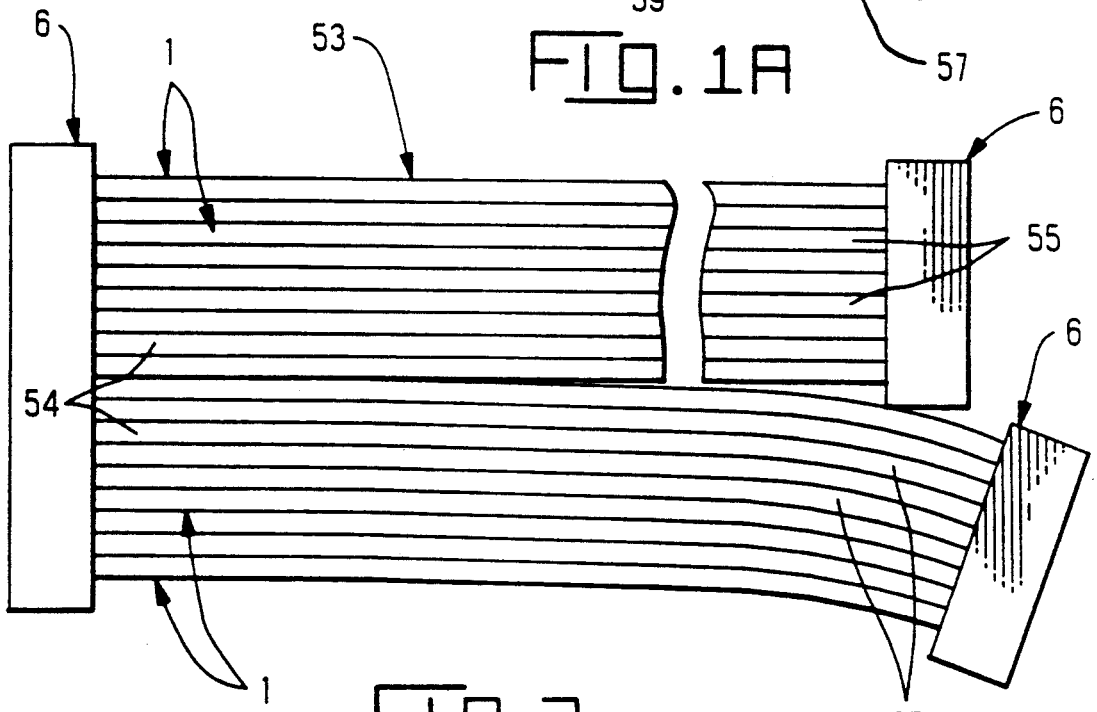
FIG. 2 is an enlarged perspective view of the fixture shown in FIG. 1.
Figure 3:
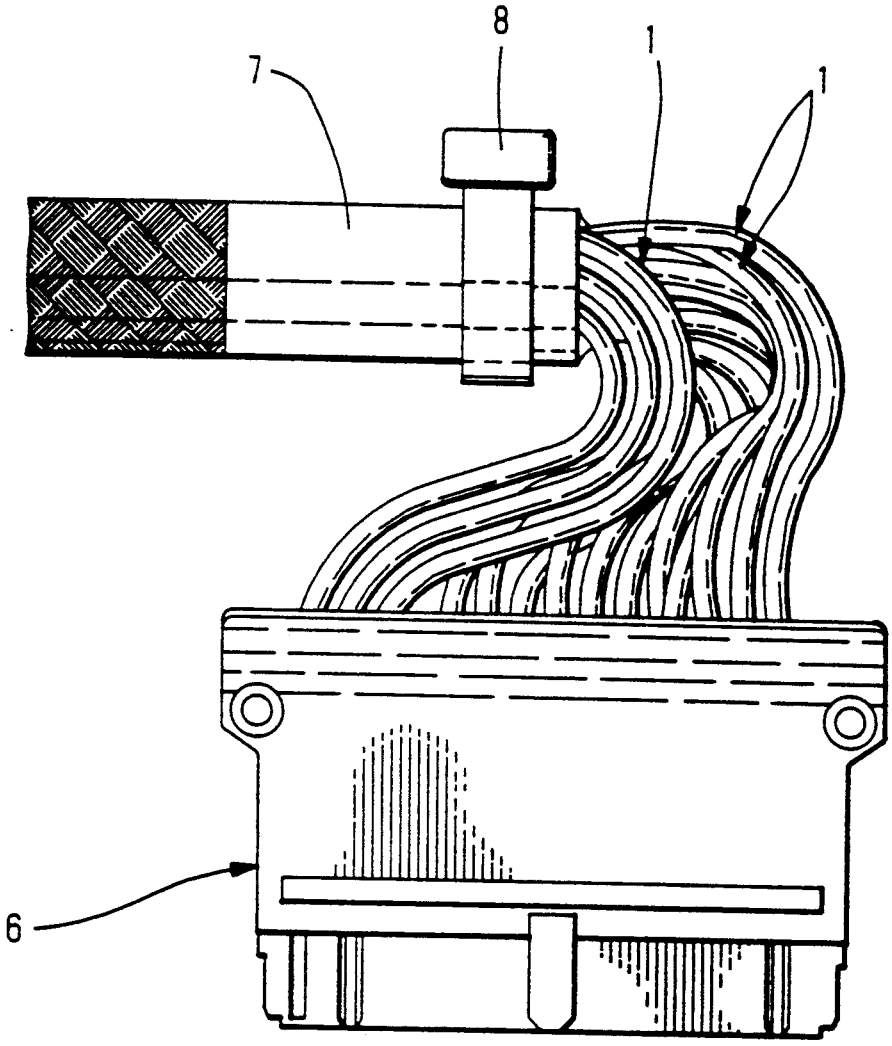
FIG. 3 is a view of a cable assembly.

With reference to FIG. 2, an electrical connector assembly 6 is connected to multiple discrete coax cables 1. For example, one form of the connector assembly 6 block is disclosed in U.S. Pat. No. 4,875,877, and can include the multiple cables 1 encircled by a sheath 7, FIG. 3 and further gathered into a bundle and encircled by a bundle tie 8. The tie 8 is usually secured to a plate, not shown, that provides strain relief to the cables 1 where they project from the sheath 7.

Figure 4:
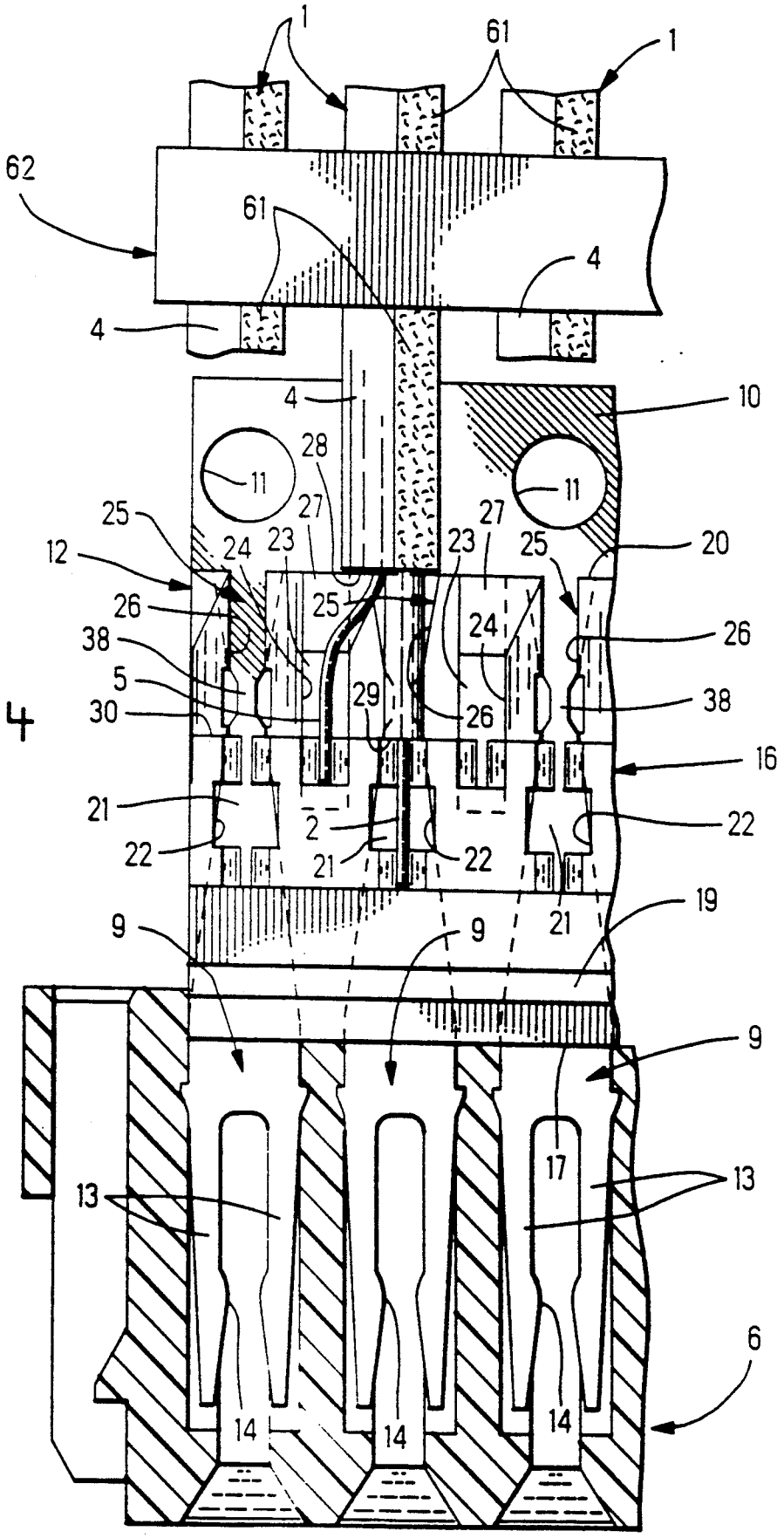
FIG. 4 is a view of a portion of a fixture d a portion of a housing block and three of the cables shown in FIG. 1.

With reference to FIG. 4, and as further disclosed in U.S. Pat. No. 4,875,877, multiple signal contacts 9 in a row project forwardly from an elongated ground bus 10 having pilot holes 11, and together form a lead frame 12. Each of the signal contacts 9 have a pair of fingers 13 defining an electrical receptacle 14 at a front end. An insulative housing block 16 includes a front end 17 with a straight front wall 18 transverse to the row of contacts 9 and forward of another front wall 19 transverse to the axis of each contact 9. The ground bus 10 projects from a rear wall 20 of the housing block 16. Wire connecting portions 21 of the contacts 9 appear at openings 22 of the housing block 16. Wire connecting portions 23 of the ground bus 10 appear at openings 24 of the housing block 16. Wire receiving channels 25 extend forwardly from the rear wall 20 and axially of corresponding contacts 9. With reference to FIG. 4, each channel 25 communicates with a first channel portion 26 that communicates with a corresponding first opening 22. A second channel portion 27 communicates with the rear wall 20 and a corresponding second opening 24. Each channel 25 receives a corresponding cable 1, such that an end 28 of the jacket 4 engages against the rear wall 20, the dielectric 3 and the signal wire 2 and the ground wire 5 extend along the channel 25, a front end 29 of the dielectric 3 engages against a rear facing wall 30, and the signal wire 2 extends from the channel 25 and along the first channel portion 26 to the wire connecting portion 21 of a corresponding contact 9, and the ground wire 5 extends along the second channel portion 27 to the wire connecting portion 23 of the ground bus 10. Each of the wires 2, are connected by a weld joint or by a solder joint to a corresponding one of the wire connecting portions 21, 23, and as further disclosed in U.S. Pat. No. 4,875,877.

Each signal contact 9 is constructed for being detached from the ground bus 10. A narrow portion 38 of each contact 9 appears at a corresponding third opening 37. Each narrow portion 38 is a removable portion that is severed to remove the same. Each signal contact is detached by severing a corresponding narrow portion 38, whereby selected signal contacts 9 are detached from the ground bus 10 and one or more other contacts 9 may remain joined to the ground bus 10. When the portion 38 is located along the wire receiving channel 25, the portion 38 is severed before the cable 1 is assembled in the channel 25. Following connection or assembly of the cables 1 to the housing block 16, the housing block 16 is assembled to the connector assembly 6, as further disclosed in U.S. Pat. No. 4,875,877.

With reference to FIG. 2, the discrete coax cables 1 permit construction of a branched cable assembly 53, wherein a group 54 of separate discrete coax cables 1 becomes divided into branches 55 of cables 1 extending to respective housing blocks 16 not shown in separate connector assemblies 6. The branches 55 can be of different lengths. By contrast, a ribbon coax cable as disclosed in U.S. Pat. No. 3,775,552, retains the wires of the cable in a single group and prevents the wires from being separated into branches. A cable assembly 53 can also be built without being branched, such that all the discrete coax cables 1 extend as a group from one connector assembly 6 to one other connector assembly, not shown.

Each of the discrete coax cables 1 is independently flexible, meaning that each discrete coax cable 1 is capable of being bent at least slightly and without the need for adjacent coax cables 1 to move together as a unit. This permits construction of a cable assembly 53 that is more flexible than a cable assembly constructed with ribbon coax cable. More specifically, a ribbon coax cable restrains the wires of the cable from movement in a plane of the cable and resists flexure of the wires along the plane of the cable. By contrast, the multiple discrete coax cables 1 are separate from one another and are independently flexible and are less resistant to flexure of the cable assembly 53.

The discrete cable 1 is manufactured with the signal wire 2 and the ground wire 5 extending straight and parallel with the axis of the cable 1, whether the cable 1 extends straight or curved along its axis. Where the term "axis" is used, the term refers to a longitudinal axis of the discrete coax cable 1 as a whole, even though the signal wire 2 and the ground wire 5 of the cable 1 can be subjected to torsion and caused to be displaced such that they extend helically along the axis rather than parallel to the axis.

The discrete coax cable 1 overcomes a disadvantage in common with all discrete coax cables, wherein the wires of such cables are skewed. A discrete coax cable is flexible in response to torsion applied to twist the cable, such that the conductors of the cable will have been displaced in response to torsion applied to the cable, and will extend helically about the axis, instead of extending parallel to the axis. Thus, such conductors are said to be skewed. When the wires 2, 5 of the discrete coax cable 1 are skewed, their orientations about the axis will vary along a helix, and will require that they be located visually and then-manually grasped and reoriented such that the conductors are positioned for alignment with corresponding wire connecting portions 21, 23 of the housing block 16. Before the invention, the wires of discrete coax cables were reoriented by hand.

The invention alleviates the time consuming task of orienting the wires by hand. With reference to FIGS. 1 and 4, the sheaths 4 of multiple cables 1 are provided with corresponding profiles 56 along the corresponding lengths of the cables 1. The cables 1 include first portions 57 having the profile 56, in part, corresponding to positions of signal wires 2 of the cable 1, and second portions 58 having the profile 56, in part, and being of different appearance than that of the first portions 57 and corresponding to positions of ground wires 5 of the cables 1. The first portions 57 have corresponding larger, thicker, first cross section portions that are substantially square, and that encircle symmetrically corresponding signal wires 2. The second portions 58 are joined to corresponding first portions 57 and have corresponding smaller, thinner, second cross section portions that are substantially triangular, and that contain corresponding ground wires 5. External surfaces 59 of the portions 58 intersect at corresponding acute angles along corresponding longitudinal edges 60 of the cable 1. The portions 57, 58 differ in coloration, in that stripes 61 of contrasting color, indicated by stippling in FIG. 1, extend along corresponding exterior flat surfaces of the first portions 57 to distinguish the same from the second portions 58. The stripes 61 provide a visual identification of the orientation of the profiles 56 of the cables 1, whether the ground wire 5 are to the right or to the left of the signal wires 2, and whether the stripes 61 are straight, indicating the wires 5 and 5 are without skew, or are skewed to indicate that the wires 2, 5 are skewed.

Each of the external profiles 56 extends uniformly along the length of a corresponding cable 1 and is constructed for orienting the signal wire 2 and the ground wire 5 of the cable 1 with respect to a longitudinal axis of the cable 1, by passing the profile 56 against a fixture 62, FIGS. 1 and 4, conforming to the shape of the profile 57. For example, the fixture 62 includes a pair of jaws 63 that close together. The cables 1 are threaded through a series of open eyes 64 between the jaws 63. The eyes 64 conform to the shape of the profiles 56, and orient the profiles 56 such that, as the cables pass through the eyes 64, the signal wires 2 and the ground wires 5 are oriented without skew and the signal wires 2 are spaced apart on the pitch spacing of the wire connecting portions 21. The cables 1 are cut as described to expose the wires 2, 5. The signal wires 2 are oriented by the fixture 62 to be laid in alignment with the wire connecting portions 21 and for connection to or assembly with the housing block 16. Similarly, the ground wires 5 are oriented by the fixture 62 to eliminate skew, and thereby to alleviate manual reorientation of the wires 5 for the purpose of eliminating skew. The ground wires are aligned with the wire connecting portions 23 for connection to or assembly with the housing block 16. Thus, the cables 1 are independently flexible, and the signal wires 2 and the ground wires 5 extend without skew along corresponding axes of the independently flexible cables 1 to the housing block 16 of a connector assembly 6. When the group 54 is divided into branches 55, FIG. 2, the cables 1 of each of the branches 55 have the first cross section portions 57 and the second cross section portions 58 extending from the connector assembly 6 without skew along the corresponding axes of the cables 1 for connection to another corresponding connector assembly 6. By eliminating skew, the cables 1 are free of internal twisting stresses, and are easily gathered into a bundle and are easily laid along a course having curves, without the cable twisting.

Figure 5:
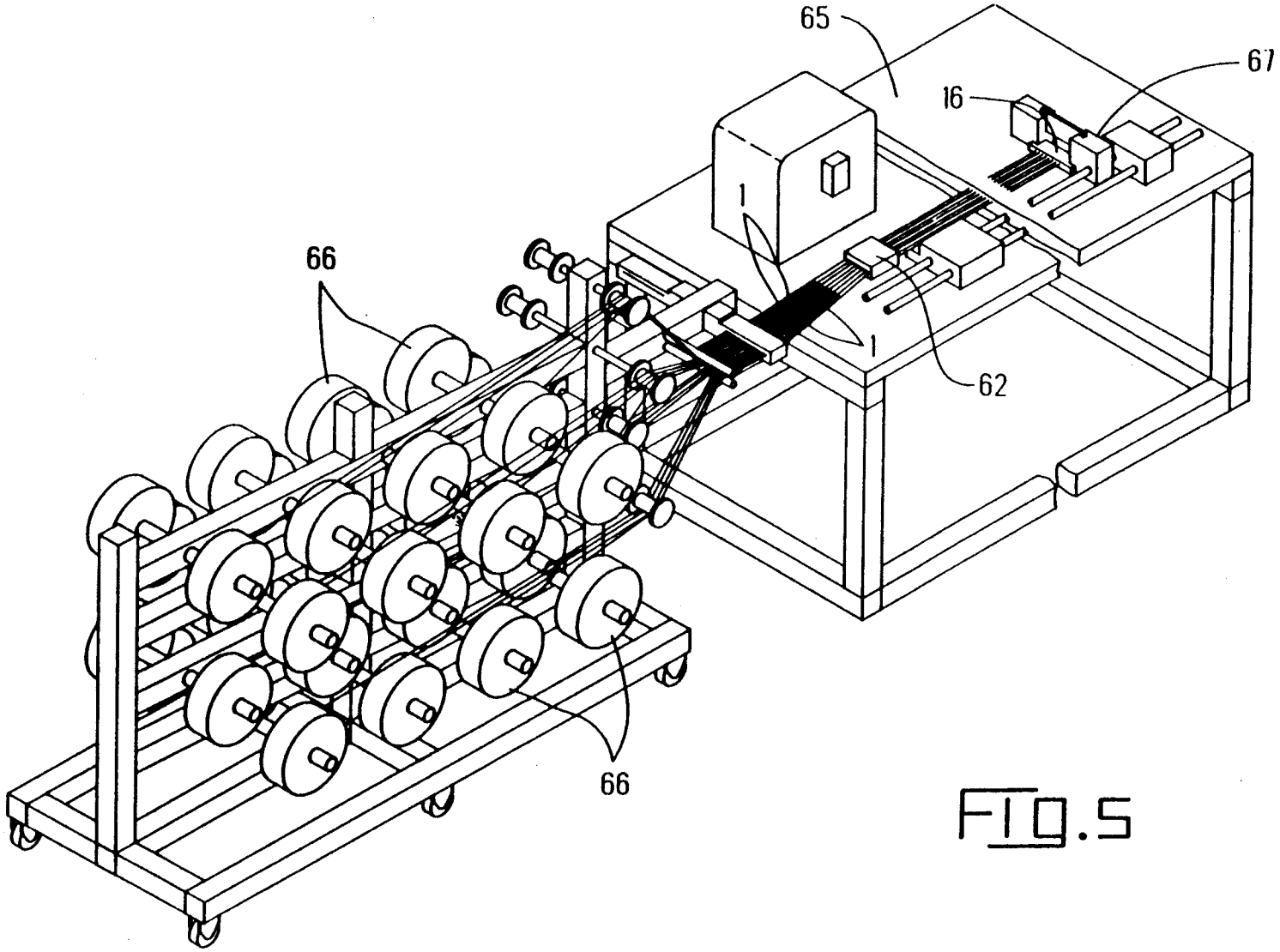
FIG. 5 is a fragmentary perspective view of a workbench with spools of discrete coax cables and the fixture for orienting the cables.

With reference to FIG. 5, the fixture 62 can be mounted on a workbench 65, the cables 1 are supplied by corresponding spools 66 on which the cables 1 are reeled, and the cables 1 are dereeled from the spools 66 and pass through the eyes 64 of the fixture 62, and the cables 1 are oriented by the fixture 62 to extend without skew to a corresponding housing block 16 of a connector assembly 6 located by a workholder 67 on the workbench 65.

Each of the advantages and features contributes independently of the others to the invention. The spirit and scope of the invention is defined in the claims that follow.

We claim:

1. A method for orienting discrete coaxial cables comprising the steps of:

providing a profile along the length of a discrete coax cable, orienting a signal wire and a ground wire of the cable with respect to a longitudinal axis of the cable by passing the profile against a fixture conforming to the shape of the profile, connecting the signal wire oriented by the fixture to a housing block and connecting the ground wire oriented by the fixture to the housing block, without combining the fixture with the housing block.

2. A method as recited in claim 1, including the steps of: extending the signal wire and the ground wire from the fixture to the housing block without skew along the axis of the cable.

3. A method as recited in claim 1, including the steps of:

passing the profile through an eye of the fixture conforming to the shape of the profile.

4. A method as recited in claim 2, including the steps of:

passing the profile through an eye of the fixture conforming to the shape of the profile.

5. A method as recited in claim 1, including the steps of:

extending the signal wire and the ground wire from the housing block to another housing block without skew along the axis of the cable.

6. A method as recited in claim 2, including the steps of:

extending the signal wire and the ground wire from the housing block to another housing block without skew along the axis of the cable.

7. A method as recited in claim 3, including the steps of:

extending the signal wire and the ground wire from the housing block to another housing block without skew along the axis of the cable.

* * * * *